US007780123B1

(12) United States Patent
Bailyn et al.

(10) Patent No.: US 7,780,123 B1
(45) Date of Patent: Aug. 24, 2010

(54) STAND FOR POURING CONCRETE

(76) Inventors: Jay Bailyn, 103 SE. 4th Ave., Apt. 301, Delray Beach, FL (US) 33444; Dan Goldburg, 113 NE. 7th St., Delray Beach, FL (US) 33444; Dustin Vain, 25 Rue De Degas, Henderson, NV (US) 89074

( * ) Notice: Subject to any disclaimer, the term of this patent is extended or adjusted under 35 U.S.C. 154(b) by 674 days.

(21) Appl. No.: 11/544,896

(22) Filed: Oct. 5, 2006

(51) Int. Cl.
*A47G 29/00* (2006.01)

(52) U.S. Cl. ..... 248/84; 248/75; 248/422; 248/83

(58) Field of Classification Search ..... 248/75, 248/80, 83, 84, 422
See application file for complete search history.

(56) References Cited

U.S. PATENT DOCUMENTS 1,667,342 A * 4/1928 Blaw ..... 248/84
1,674,493 A * 6/1928 Adams ..... 248/83
1,942,453 A * 1/1934 Ruemelin ..... 248/75
2,369,950 A * 2/1945 Daly ..... 239/265
2,428,865 A * 10/1947 Brosemer ..... 248/75
2,578,036 A * 12/1951 Berke ..... 222/536
2,694,600 A * 11/1954 Richey ..... 285/61
2,792,257 A * 5/1957 Davis ..... 239/276
3,869,088 A * 3/1975 Dykmans ..... 239/750
4,730,408 A * 3/1988 Miller ..... 43/15
4,988,063 A * 1/1991 Pucillo ..... 248/83
6,668,497 B1 * 12/2003 Mayer et al. ..... 52/126.1
6,893,067 B1 * 5/2005 Ayala ..... 294/15

* cited by examiner

*Primary Examiner*—J. Allen Shriver, II
*Assistant Examiner*—Bradley H Duckworth
(74) *Attorney, Agent, or Firm*—Gold & Rizvi, P.A.; Glenn E. Gold; H. John Rizvi

(57) ABSTRACT

A stand for use in pouring concrete is provided. The stand includes a boom that is configured for holding a hose for use in dispensing concrete slurry therefrom. The stand also has a column that supports the boom. A base is present and extends from the column. The base also provides stability to the column to help prevent it from tipping over. In other variations, the height of the boom can be adjustable with respect to the base. Also in other variations the boom may be configured so as to pivot or rotate with respect to the base.

7 Claims, 6 Drawing Sheets

STAND FOR POURING CONCRETE

BACKGROUND OF THE INVENTION

1. Field of the Invention

The present invention relates generally to a stand for use in pouring concrete. More particularly, the present application involves a movable stand that allows a user to hold a concrete slurry hose to fill a concrete block wall without having to climb onto the wall or use a ladder.

2. Discussion of the Related Art

Buildings produced by concrete block construction have walls that are made from concrete blocks. The concrete blocks generally have two open cells and are arranged on top of one another so that the cells extend in a vertical direction. The concrete blocks are staggered with respect to one another but are arranged so that the cells are aligned from the floor to the upper end of the structure. Vertically disposed rebar is located within selected columns of cells and extends through their entire height. The amount and location of rebar can be chosen to achieve a desired amount of reinforcement. In some instances a cage of rebar is formed by attaching horizontal rebar at the top of the structure to the vertical rebar which is likewise attached to rebar protruding from the foundation. Concrete is poured into the cells and around the rebar to form an extremely strong rebar reinforced concrete wall structure once hardened.

The top of the concrete wall is sometimes provided with a tie beam or a bond beam. A tie beam is formed by attaching plywood to the top of the interior and exterior surfaces of the concrete and block wall to form a void into which rebar is placed and that is subsequently filled with concrete. A bond beam is a series of U-shaped blocks that make up the top of the concrete wall. Rebar is placed in the U-shaped blocks and they are subsequently filled with concrete. The rebar reinforced concrete filled tie beam or bond beam acts to further reinforce the structure.

The pouring of concrete into the cells and the tie beam or bond beam can be a difficult and potentially dangerous task. A conventional method of performing this task involves driving a cement truck or other concrete carrying vehicle to the construction site and then transferring concrete into a concrete pump. The concrete pump has a hose with an outlet end through which the concrete slurry can be dispensed. A person sometimes referred to as a hose handler stands on the top of the concrete wall or stands on a ladder and communicates to an operator of the concrete pump for the purpose of starting and stopping the flow of concrete. The hose handler directs the flow of concrete slurry into the cells and the beams. Another individual sometimes referred to as a troweler is located behind the hose handler. The troweler smoothes the concrete and inserts hurricane tie-down straps into the setting concrete.

A problem exists in the conventional pouring of concrete slurry into concrete walls in that the hose handler and troweler are unsupported and can fall from the wall or ladder, which can be from seven to over twenty feet in height. The hose handler is in a particularly unsafe position as he or she must maintain balance and hold and control the concrete hose. One solution to increase safety in pouring concrete slurry into beams or cells in concrete walls is to erect scaffolding around the concrete wall. This approach is undesirable in that it is extremely time and labor intensive. For example, it may take an entire day to set up scaffolding around a single job site whereas a pumping crew can complete two to three average homes in the same day.

Additional solutions to improving the pouring of concrete slurry into concrete walls have been proposed. One prior device includes a holder that is supported on the top of the concrete wall and has an elongated body onto which a length of the concrete hose is strapped. This type of device is advantageous in that the hose handler need only support a shorter length of the hose. Once a column of cells is filled with concrete slurry, the holder is lifted by a user on the ground and moved along the length of the concrete wall to be positioned at another set of cells. This type of device is problematic in that the hose handler is located at the top of the concrete wall and again assumes the risk of falling therefrom. As such, there remains room for variation and improvement within the art.

SUMMARY OF THE INVENTION

Various features and advantages of the invention will be set forth in part in the following description, or may be obvious from the description, or may be learned from practice of the invention.

One aspect of the present invention provides for a stand for use in pouring concrete. The stand includes a boom that is configured for holding a hose for use in dispensing concrete slurry. A column is also provided and supports the boom. Further, a base is present and extends from the column. The base provides stability to the column.

The present invention also provides for a stand as immediately discussed that includes a column that has a first portion that is an inner sleeve. The inner sleeve is at least partially disposed within a second portion that is an outer sleeve. The inner sleeve is movable with respect to the outer sleeve so that the height of the column is adjustable.

Also included in a further aspect of the present invention is a stand as immediately discussed that further has a rack carried by the inner sleeve. A worm is also present and is in communication with the rack. A handle is included and is in communication with the worm. Movement of the handle causes the worm to rotate to effect movement of the rack in order to cause adjustment of the height of the column.

An additional aspect of the present invention exists in a stand for use in pouring concrete. The stand includes a boom that is configured for holding a hose that is used to dispense concrete slurry therefrom. The boom extends at an angle to the vertical direction. A column is present and acts to support the boom. The height of the column is adjustable so that adjustment of the height of the column adjusts the height of the boom. The stand also includes a base that has at least three legs that form a perimeter into which the column is located. The base holds the column off of the ground. At least two of the legs of the base are extendable towards and away from the column.

The present invention also provides for, in one aspect, a stand as immediately discussed that further includes a rack that is carried by a first portion of the column. A worm is also present and is in communication with the rack. The stand further has a handle that is in communication with the worm so that movement of the handle is translated to the worm. The movement causes the worm to rotate to effect movement of the rack in order to cause adjustment of the height of the column.

The present invention in an additional aspect also provides for a stand as immediately discussed that further has a guide arm that extends from the column. The guide arm is configured for positioning the hose. At least two of the legs of the base telescope so that the lengths of the legs are adjustable.

A further aspect of the present invention exists in a stand as discussed above in which the base has at least three legs that carry a caster.

An additional exemplary embodiment of the present invention is found in a stand as discussed above in which the boom may pivot with respect to the column. The axis about which the boom pivots is horizontal with respect to the ground.

Another aspect of the present invention is found in a stand as immediately mentioned above that further has a positioning arm that is connected to the boom. A support member is present and extends from the column. The support member is also connected to the positioning arm. The positioning arm is used to fix the boom at a desired position with respect to the column.

Another aspect of the present invention exists in a stand as immediately discussed that further includes a counterweight that is carried by the support member.

Another aspect of the present invention exists in a stand as discussed above in which the boom can rotate with respect to the base such that the axis of rotation is perpendicular to the ground.

A further aspect exists in a stand as described above in which the boom carries a mirror for use in viewing voids to be filled in a concrete wall.

The present invention provides for, in one aspect, a stand that is used for pouring concrete. The stand has a boom that is configured for holding a hose for the dispensing of concrete slurry. The boom extends substantially in the horizontal direction and has at least one clamp for use in holding the hose. A column is present and supports the boom. The column has a first portion and a second portion. A rack is carried by the first portion of the column. A worm is in communication with the rack, and a handle is in communication with the worm. Movement of the handle is translated to the worm to cause the worm to rotate to effect movement of the rack in order to cause adjustment of the height of the first portion with respect to the second portion of the column. Adjustment of the height of the first portion causes adjustment of the height of the column. A base is present and has at least three legs that form a perimeter into which the column is located. The base holds the column off of the ground. At least two of the legs are extendable towards and away from the column. A guide arm extends from the column and is configured for positioning the hose. A caster is attached to each of the legs in order to keep the legs off of the ground and to aid in providing mobility to the base.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs., in which.

Figure 1:
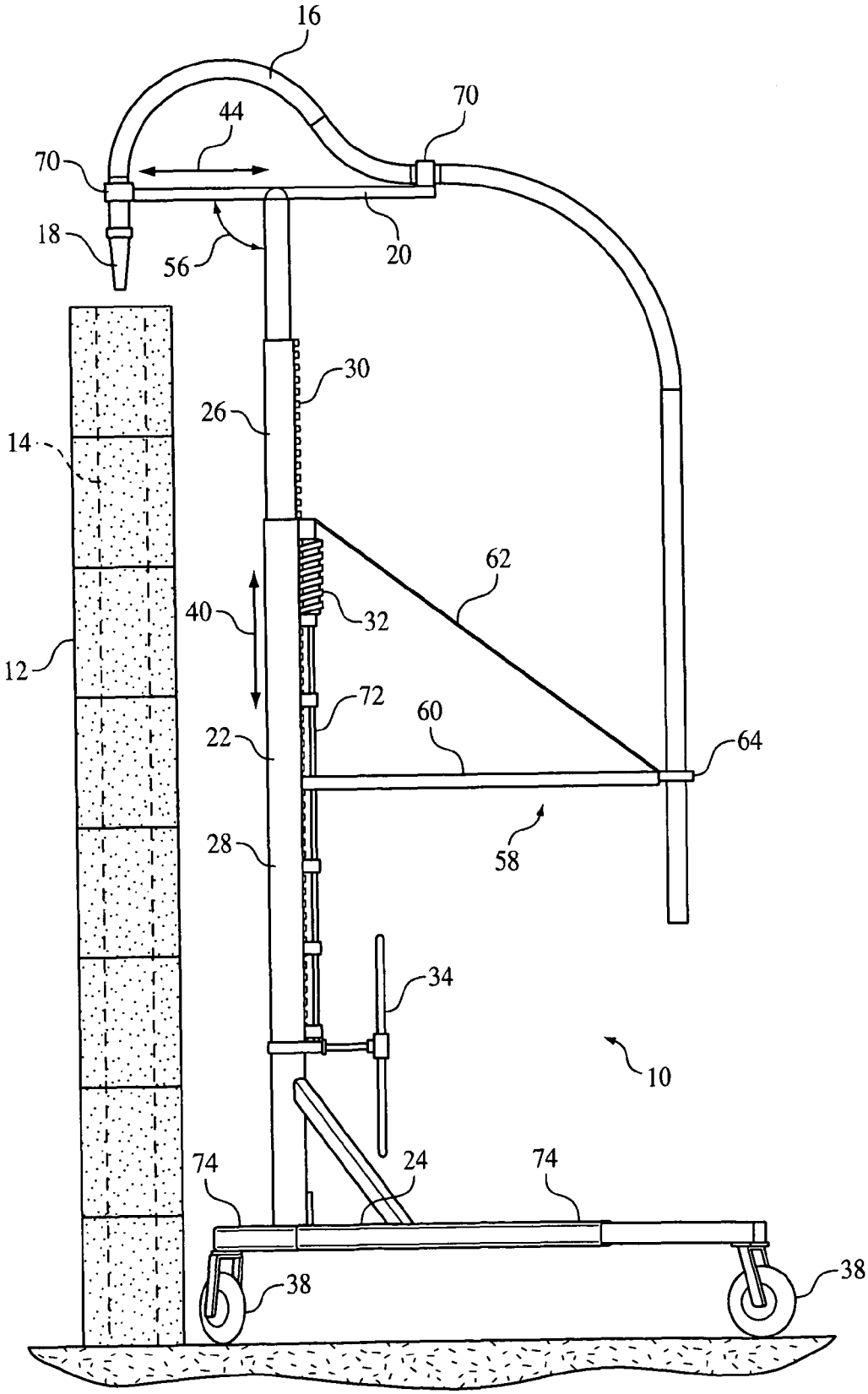
FIG. 1 is a side view of a stand for use in pouring concrete in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present application provides for a stand 10 that assists a user in pouring concrete slurry into beams and cells 14 of a concrete wall 12. The stand 10 includes a boom 20 capable of holding a hose 16 through which the concrete slurry is dispensed. The user can manipulate the stand 10 from the ground so that he or she does not have to be located on top of or on a ladder adjacent to the concrete wall 12 in order to direct concrete slurry into beams or cells 14. Various embodiments of the stand 10 are presented that allow for the position of the hose 16 to be set along three axes to control the dispensing position of the concrete slurry.

Figure 2:
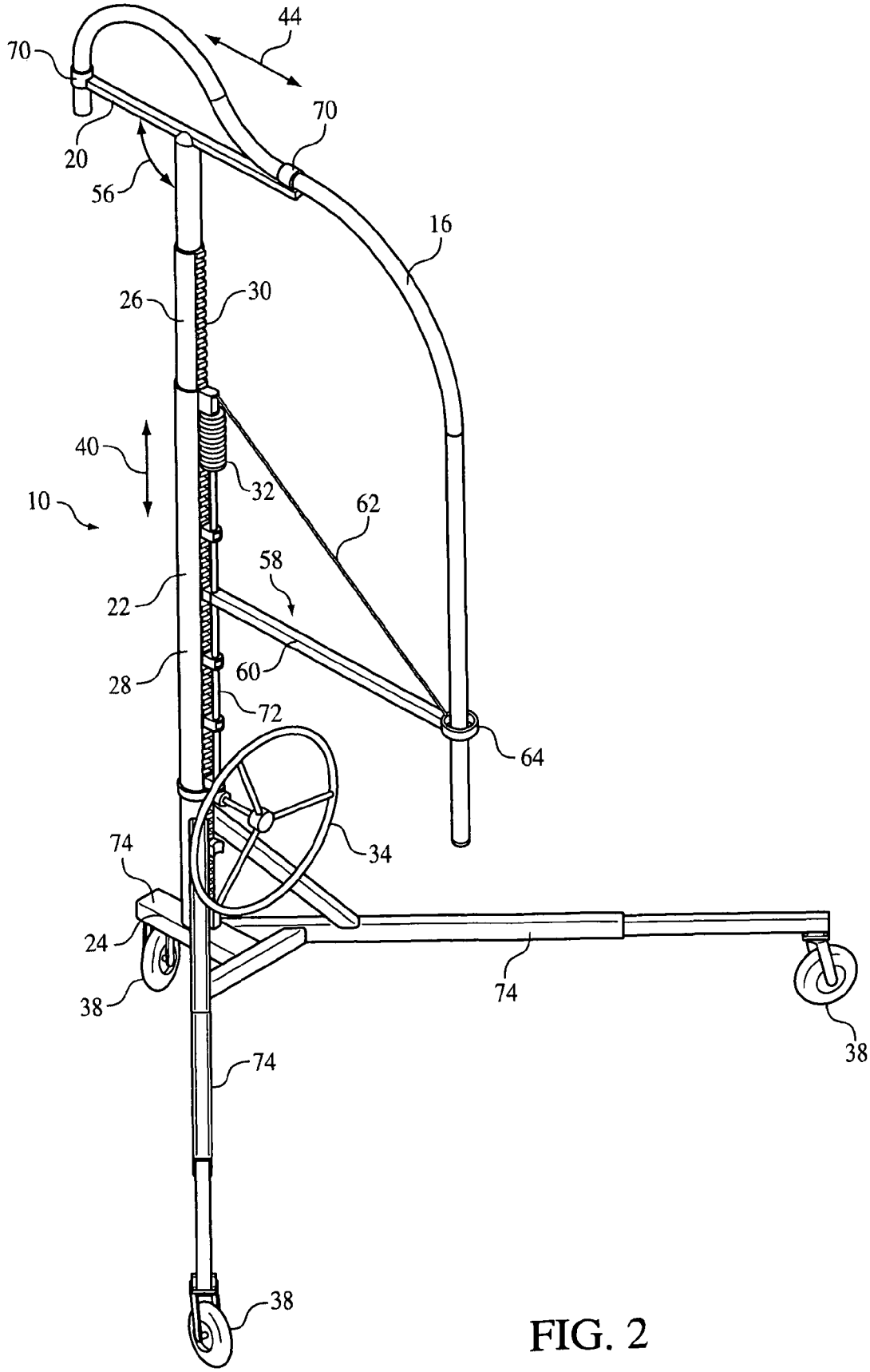
FIG. 2 is a perspective view of the stand of FIG. 1.

An exemplary embodiment of the stand 10 is shown in FIGS. 1 and 2. In use, the user can push the stand 10 into position proximate to the concrete wall 12 so that a nozzle 18 of hose 16 is positioned over a series of cells 14 of the concrete wall 12 that are to be filled. The vertical position of the nozzle 18 can be lowered by the user in order to further position the nozzle 18 for dispensing of concrete slurry therefrom. A column 22 supporting the boom 20 that holds hose 16 is movable in the vertical direction 40 for making this adjustment. Once properly positioned, the user can signal an operator of the pump to begin pumping concrete slurry. As concrete slurry flows from the nozzle 18, the user can move the stand 10 along a beam that is being filled. Upon reaching the location of cells 14, the vertical position of nozzle 18 can again be lowered as far as possible for the purpose of pouring concrete directly into the cells 14. Upon filling the cells 14, the vertical position of nozzle 18 can be raised and the stand 10 may again be moved along the beam to dispense concrete slurry therein.

The stand 10 includes a base 24, which supports column 22, which in turn supports boom 20. The hose 16 is held onto boom 20 by a pair of clamps 70. Clamps 70 can be provided in a variety of manners for use in holding the hose 16. Clamps 70 can include a ring portion that surrounds the hose 16 and is then tightened and fixed thereon through the use of a bolted connection. Alternatively, the clamps 70 may be snap-fit members or can act to hold the hose 16 through a frictional engagement. As shown, the clamps 70 are provided on boom 20 so as to hold the hose 16 in the horizontal direction 44 on one end of boom 20 and in the vertical direction 40 on another end of boom 20. The boom 20 can be made out of any suitable material and can have a variety of cross-sectional shapes. For example, boom 20 can be made of steel, aluminum or plastic in certain exemplary embodiments. Boom 20 can have a U-shaped, rectangular, circular, triangular, tubular or I-beam shaped cross-section. Although shown as having a generally elongated and uniform shape, it is to be understood that the boom 20 can be variously shaped in accordance with other exemplary embodiments so long as it is configured for holding the hose 16.

The boom 20 is connected at its midpoint to the top of the column 22. Boom 20 is oriented at an angle 56 of 90° to the vertical direction 40. In the exemplary embodiment shown, boom 20 is rigidly connected to column 22 so that the angle 56 remains at 90°. It is to be understood, however, that angle 56 can be different in other embodiments. For example, angle 56 may be from 30° to 150° in other exemplary embodiments of the present invention. Also, in other embodiments boom 20 can be adjustable with respect to column 22 so that angle 56 can be varied as desired. Boom 20 can be attached to the top of column 22 is any suitable manner. For example, welding, adhesion or mechanical fasteners may be employed to connect these two components. Further, boom 20 and column 22 can be formed integrally with one another in accordance with certain embodiments.

Column 22 includes a first portion 26 and a second portion 28. The first portion 26 is arranged as an inner sleeve that slides within the second portion 28 that is arranged as an outer sleeve. The first portion 26 moves in the vertical direction 40 with respect to the second portion 28 so as to render boom 20 movable in the vertical direction 40 due to its attachment to the first portion 26. Although shown as having a pair of portions 26 and 28 that are tubular sleeves, the column 22 can be configured differently in accordance with other exemplary embodiments of the present invention. For example, the column 22 can be a single unitary member that has a channel, square, I-beam, rectangular or triangular shaped cross-section. Further, the column 22 may have two or more telescoping portions that allow for adjustment of its height. Still further, in other embodiments the column 22 need not be adjustable in the vertical direction 40.

The stand in FIGS. 1 and 2 includes a worm drive mechanism that enables a user to adjust the height of the column 22 in the vertical direction 40. As previously stated, adjustment of the height of column 22 causes the boom 20 to also adjust in the vertical direction 40 which results in an adjustment of the position of nozzle 18 in the vertical direction 40. The mechanism for effecting vertical adjustment of the column 22 includes a rack 30 that is attached to a length of the first portion 26. Rack 30 includes a series of teeth that can have any suitable shape. A worm 32 has threads suitable for meshing with those of rack 30 and is in communication therewith. Rotation of worm 32 causes the rack 30 to be moved in the vertical direction 40 due to the interaction of the threads of worm 32 and rack 30. Reversal of the direction of rotation of worm 32 causes a corresponding reversal of the direction of travel of rack 30 in the vertical direction 40. As the rack 30 is rigidly attached to first portion 26, movement of the rack 30 in the vertical direction 40 causes the first portion 26 to likewise move in the vertical direction.

Worm 32 is arranged so as to have an axis that extends in the vertical direction 40. A rod 72 extends from worm 32 and runs in the vertical direction 40 next to a part of the length of the first portion 26. The rod 72 is rigidly attached to the worm 32 so that rotational movement of rod 72 causes the worm 32 to likewise rotate. A series of members project outwardly from the second portion 28 for use in positioning or supporting the rod 72. A handle 34 is carried by the column 22 and can be rotated by the user. Although shown as a wheel in the exemplary embodiment in FIGS. 1 and 2, handle 34 can be a knob, lever or any other member capable of being turned by the user in other embodiments. A bevel gear arrangement, not shown, can be used to transfer rotation of the handle 34 90° to the rod 72. The user can rotate handle 34 so that this rotation is eventually transferred into a linear motion of the rack 30 and to the boom 20 and associated hose 16. Reversing the turning direction of handle 34 will cause the boom 20 to likewise move in the opposite direction in the vertical direction 40.

A base 24 is used to support the column 22. In the exemplary embodiment shown, base 24 includes three legs 74 that are configured in an isosceles orientation with the column 22 located proximate to the front leg 74. The legs 74 thus form a perimeter into which the column 22 is located. The side legs 74 are wider than the front leg 74 and also are configured to telescope so that their lengths can be adjusted. In this manner, the lengths of legs 74 can be shortened at times when the stand 10 is being transported from one job site to another or in order to fit the stand 10 into a smaller, tighter space during use. The telescoping legs 74 can be made of two members that can slide relative to one another and be locked into place by use of a mechanism such as a locking member. Although described as having two telescoping legs 74 and one non-telescoping leg 74 it is to be understood that all of the legs 74 can be telescoping or non-telescoping in other embodiments. The legs 74 can be made of any suitable material such as steel, aluminum or plastic. Further, the cross-sectional shape of the legs 74 can be variously configured. The legs 74 can have square, rectangular, triangular, circular, tubular or channel shaped cross-sections. Although three legs 74 are shown, it is to be understood that any number of legs 74 can be present in other embodiments. Further, the base 24 need not have legs 74 in other versions of the present invention. The base 24 can be sized so as to have a foot print large enough to prevent the stand 10 from tipping during use. The boom 20 extends slightly beyond the footprint of the base 24 and has an end located just in front of the front leg 74 in the horizontal direction 44

Casters 38 are attached to each one of the legs 74. Casters 38 aid in moving the stand 10 by a user across the ground, foundation, floors or other surface of the building. One or more of the casters 38 can swivel to allow for the stand 10 to be moved in any direction. In other embodiments, the casters 38 need not be capable of swiveling. The stand 10 also includes a guide arm 58 that is present for assisting in locating a portion of the hose 16. During use of the stand 10, it may be the case that the hose 16 will inadvertently contact the user or other items present at the construction site. The guide arm 58 helps maintain at least a portion of the hose 16 at a known location, for example behind the user when employing the stand 10. The guide arm 58 has a bar 60 that extends from column 22. Bar 60 is rigidly attached to the second portion 28 of column 22 and thus remains stationary during movement of the first portion 26. However, in other embodiments the bar 60 can be arranged so as to move in the vertical direction 40 in response to movement of a portion of the column 22. A loop 64 is present on one end of the bar 60 and has the hose 16 disposed therethrough. The loop 64 thus maintains the hose 16 at a known position with respect to at least a portion of the remainder of stand 10. A line 62 is attached to the column 22 and also to a portion near the end of bar 60 in order to provide support to the bar 60 as it is cantilevered from column 22.

The stand 10 in FIGS. 1 and 2 can thus be moved by a user along the ground, foundation, floors, or other surfaces of the building with the use of casters 38 so that the stand can be positioned at various locations along the concrete wall 12. Further, the boom 20 can be raised and lowered in the vertical direction 40 through the turning of handle 34. The user can thus position the nozzle 18 at a desired location as the hose 16 is held by the stand 10.

Figure 3:
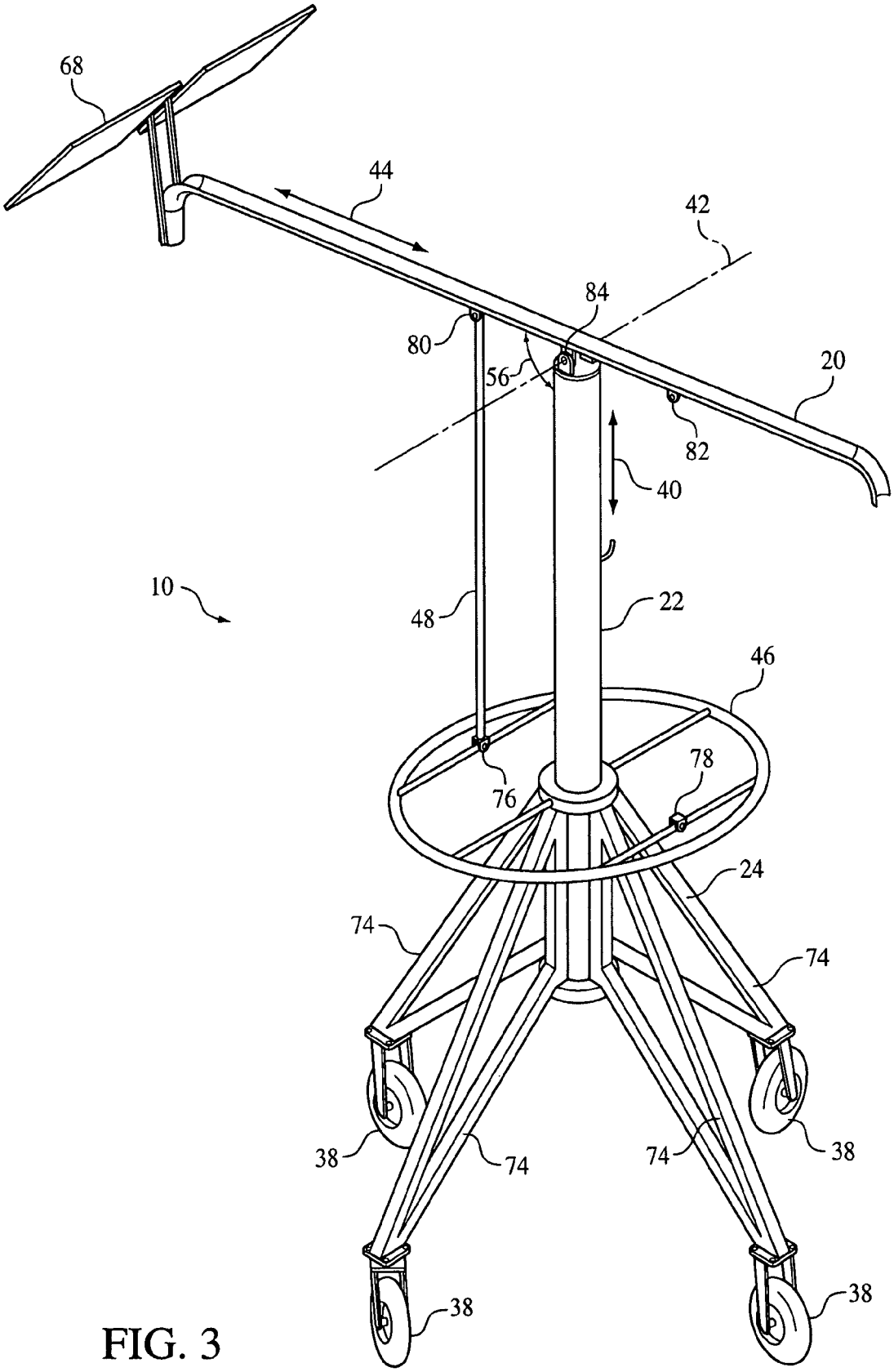
FIG. 3 is a perspective view of a stand for use in pouring concrete in accordance with another exemplary embodiment of the present invention.

An additional exemplary embodiment of the stand 10 is shown in FIG. 3. Here, the base 24 of stand 10 has four legs 74 that act to stabilize and support the remaining portions of stand 10. Each of the legs 74 is made of an angular extension that is attached to a portion of column 22. Casters 38 are present for helping render the stand 10 mobile. The legs 74 in this exemplary embodiment are fixed with respect to their position to column 22. Boom 20 is attached to the top of column 22 by way of a pivot connection 84 that allows the boom 20 to pivot about axis 42. Axis 42 is oriented in a direction perpendicular to the vertical direction 40 and is at 90° to the direction the boom 20 extends.

A positioning arm 46 is connected to the column 22 and extends therefrom. The positioning arm 46 has a circular outer member with bars that traverse the interior portion. A support member 48 is attached to the positioning arm at connection point 76 and to the boom 20 at connection point 80. The connection points 76 and 80 can be made with any type of attachment. For example, the connection points 76 and 80 can be made with mechanical fasteners or through a friction fit arrangement. Further, the attachment of support member 48 to the connection points 76 and 80 can be made without the use of any fasteners but may simply be held thereto through the weight of the boom 20. The support member 48 may act to position the boom 20 at a desired angle 56 to the vertical direction 40. The support member 48 can be a rigid member that is of a fixed length. Alternatively, the support member 48 can have a height that is adjustable so that it can be extended in order to allow for further adjustment of the angle 56 between the boom 20 and the vertical direction 40.

The stand 10 can be adjusted in order to modify the position of the nozzle 18 of hose 16 during work on the concrete wall 12. In this regard, the user can detach the support member 48 from the connection points 76 and 80. Next, the user may attach support member 48 to connection points 78 and 82 that are located on an opposite side of the column 22. Due to the angular orientation of the positioning arm 46 with respect to the vertical direction 40 in addition to or alternatively to the height of the support member 48, the angle 56 can be varied as opposed to when the support member 48 is attached at connection points 76 and 80. The connection points 78 and 82 can be configured in the same or in a different manner to connection points 76 and 80. Although shown as having connection points 76 and 78, the support member 48 can be attached to other portions of the positioning arm 46 in order to further adjust the angle 56 that the boom is positioned. For instance, the circular area of the positioning arm 46 immediately outboard of the connection points 76 and 78 can be used to attach the support member 48 thereto.

The boom 20 of the stand 10 is configured generally as a half-pipe. This shape conforms to the shape of the hose 16 and allows the hose 16 to lie along its length. Clamps do not have to be used to secure the hose 16 to the boom 20 as the shape of boom 20 prevents the hose 16 from falling. However, in other embodiments of the invention, fasteners such as clamps can be used to further secure hose 16 to boom 20. The ends of boom 20 curve downward in order to allow for a smoother transition of the hose 16 to and from the boom 20.

A mirror 68 is attached to boom 20. As shown, the mirror 68 is attached to an end of the boom 20, but is to be understood that mirror 68 can be attached at other locations on boom 20. Mirror 68 extends on either side of boom 20 and has a reflective surface that is oriented at an angle to the direction of extension of boom 20. A user can stand on the ground or next to stand 10 and view the interior of the beam, cells 14 or other portions of the concrete wall 12. As such, the user need not climb onto the concrete wall 12 for inspection purposes or in order to view the location being filled with concrete slurry. The orientation of mirror 68 can be fixed with respect to the boom 20 or can be adjustable in order to allow for different areas to be viewed by a user or in situations in which the user must stand at a location other than right next to the stand 10. The mirror 68 can also be used in other exemplary embodiments of the present invention. For instance, the mirror 68 can be attached to the embodiment in FIGS. 1 and 2 for use in aiding the view of the user.

Although described as using a mirror 68, a camera or other optical device can be used to view the interior of the beam, cells 14 or other portions of the concrete wall 12. In this regard, the camera can be positioned on an end of boom 20 and can transmit an image back to the user of the stand 10 to aid in the pouring of concrete. The camera can transmit wirelessly to a monitor positioned adjacent to stand 10 capable of being viewed by the user. Alternatively, the camera may be hard wired to a monitor located adjacent the stand 10 or in certain embodiments located on the stand 10. Here, the line can run from the camera on the underside of boom 20 and down column 22 to the monitor. The camera can be mounted in a single position with respect to boom 20 or can be capable of being actuated in order to move with respect to boom 20. Any type of camera can be employed. The camera can be a fiber optic camera in certain exemplary embodiments, and in accordance with one embodiment the camera is a fiber optic flex camera having model number ST-403WC distributed by Pentagon Defense Products, with offices located at 803 Heritage Drive, Ft. Lauderdale, Fla. 33326.

Figure 4:
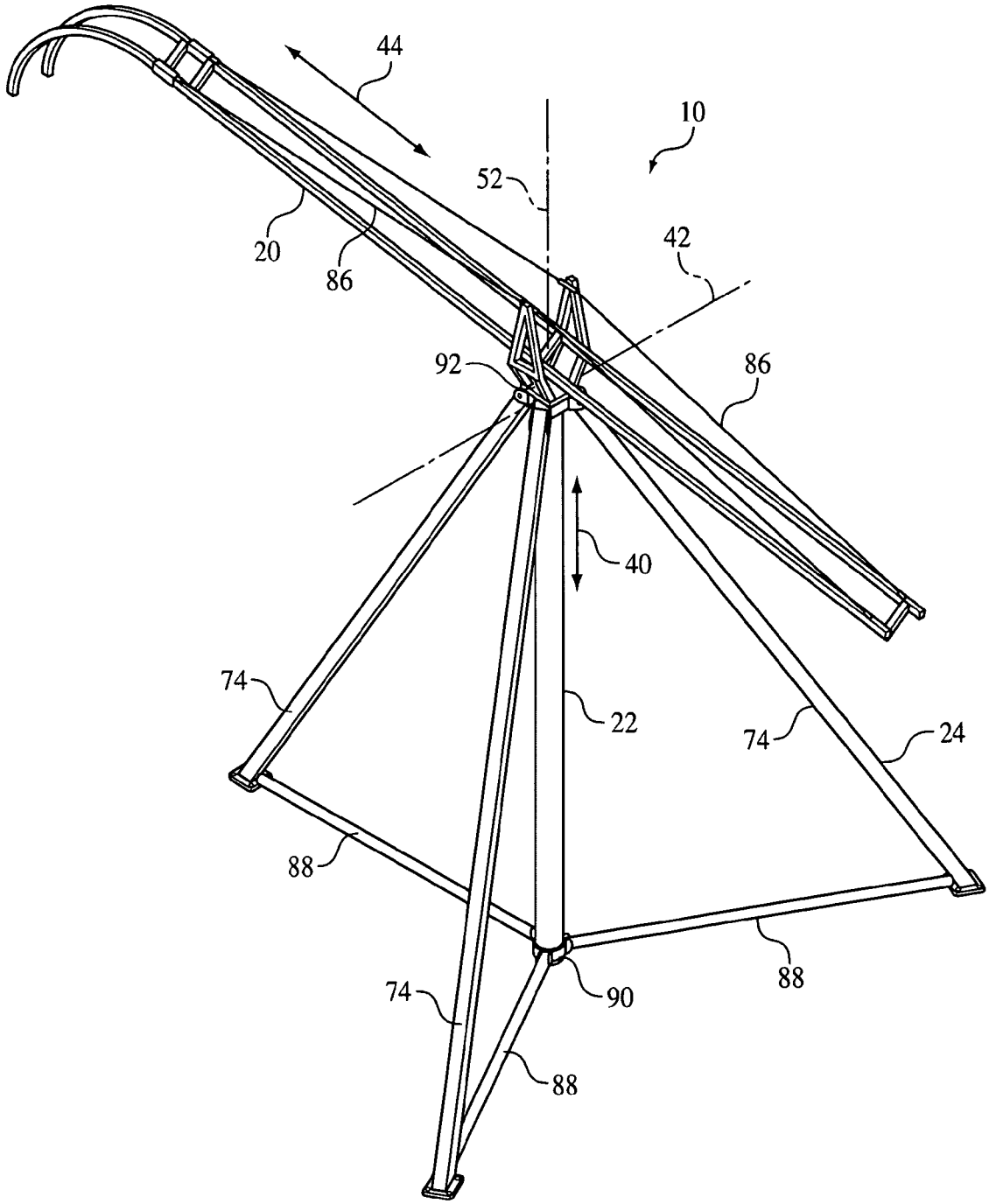
FIG. 4 is a perspective view of a stand for use in pouring concrete in accordance with another exemplary embodiment of the present invention.

An additional exemplary embodiment of the stand 10 is shown in FIG. 4. Here, the stand 10 has a base 24 that includes three legs 74. The legs 74 are connected near the top of column 22 and can pivot. The legs 74 are attached to guide members 88 that are connected to a ring 90 that slides along the length of column 22 in order to allow the legs 74 to fold towards the column 22. In this manner, the footprint of the base 24 can be adjusted as needed. The ring 90 attaching guide members 88 can be locked at points along the length of the column 22 in order to fix the footprint of the base 24. Also, the base 24 can be folded towards the column 22 so that the guide members 88 and legs 74 rest against the column 22 in order to reduce the size of the stand 10 for purposes of transport. The base 24 does not include casters 38 in the exemplary embodiment shown.

The boom 20 is attached to the top of the column 22 by way of a rotation connection 92. Rotation connection 92 allows the boom 20 to rotate about axis 52 for purposes of positioning the nozzle 18 of hose 16. Axis 52 extends in the vertical direction 40 and in the exemplary embodiment shown is co-axial with the axis of column 22. The boom 20 does not pivot with respect to the column 22 as previously described with respect to the embodiment in FIG. 3. Further, the height of the column 22 is not adjustable in the exemplary embodiment of FIG. 4. As such, the only adjustment shown in this embodiment with respect to the position of the hose 16 is rotation about all or a portion of axis 52. However, the present invention includes various exemplary embodiments where the stand is adjustable in one, two or all three of the aforementioned directions.

The boom 20 includes a pair of elongated members that are positioned next to one another so as to allow the hose 16 to be positioned between the members. An end of the boom 20 is curved in order to allow for a smooth transition of the hose 16 off of the boom 20. A pair of cables 86 are present in order to give structural support to the boom 20. Although described as only being capable of rotating about axis 52, the stand of FIG. 4 can be configured so that the boom 20 can pivot or be adjusted in the vertical direction 40 as previously discussed.

Figure 5:
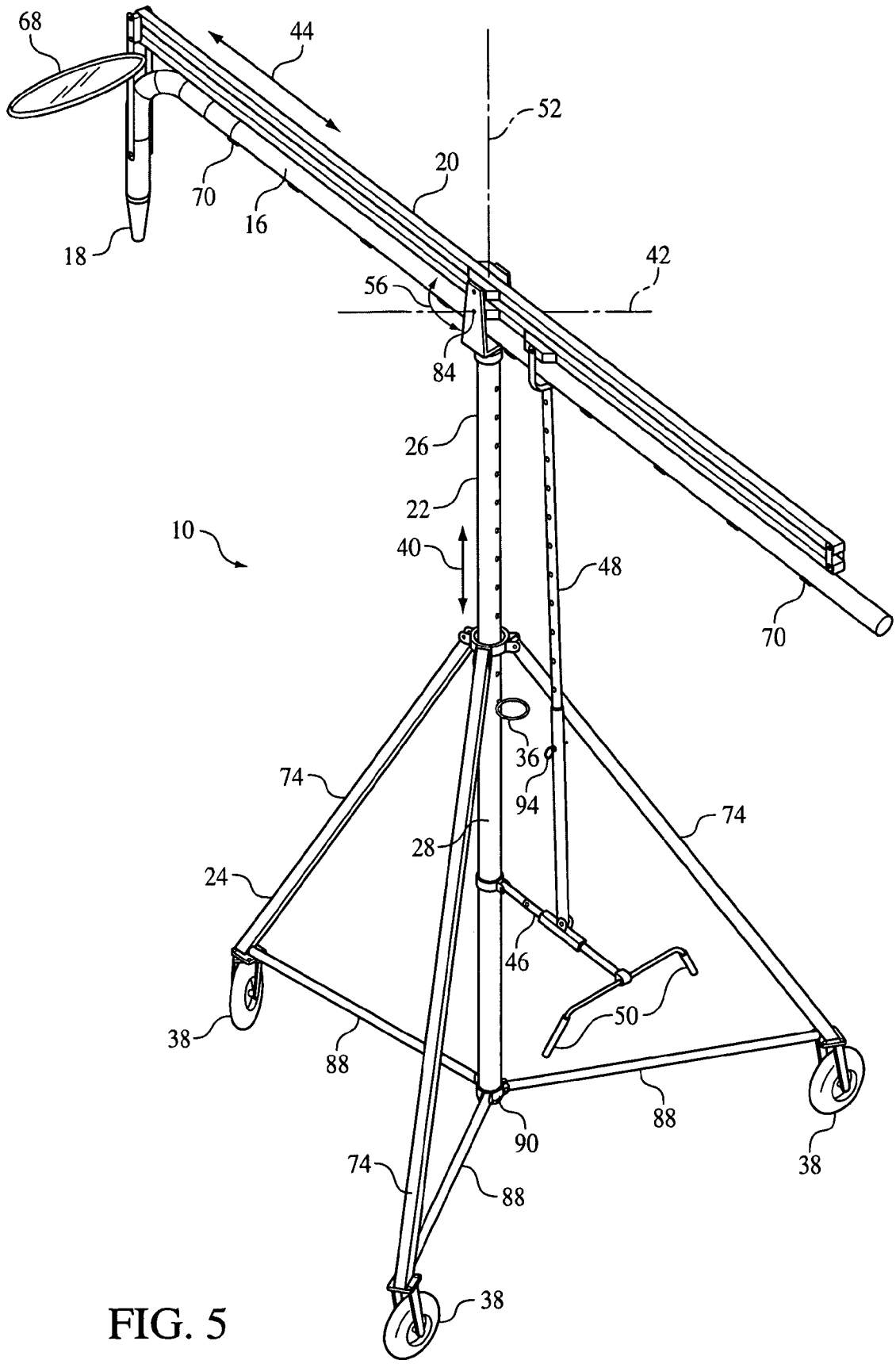
FIG. 5 is a perspective view of a stand for use in pouring concrete in accordance with another exemplary embodiment of the present invention.

A further exemplary embodiment of the stand 10 is shown in FIG. 5. Here, the base 24 includes three legs 74 and three guide members 88. The legs 74 and guide members 88 can be adjusted so that the base 24 can be folded up for transport purposes. The legs 74 each carry a caster 38 for use in rendering the base 24 mobile. Column 22 is capable of telescoping in order to adjust its height, which likewise adjusts the height of boom 20. A locking member 36 is used in order to fix the height of column 22 at a certain location. The user can remove locking member 36 from column 22 and adjust the telescoping portion to a desired height. Next, the user may reinsert locking member 36 to fix the height of column 22.

A positioning arm 46 is connected to the column 22 with respect to which it may pivot. Positioning arm 46 extends from column 22. A support member 48 extends from the positioning arm 46 and is connected to the boom 20. The height of the support member 48 is adjustable as it includes a telescoping portion that can be locked into a fixed position through the use of a locking device 94 such as a pin. The user can grasp a pair of hand grips 50 attached to the positioning arm 46 and pivot the boom 20 about axis 42. The handgrips 50 can also be employed by a user to move the stand 10 on casters 38. The boom 20 is made of a pair of elongated members that extend substantially the same length on opposite sides of the column 22. The hose 16 is attached to the bottom of boom 20 through the use of a series of clamps 70. A mirror 68 is also affixed to one end of the boom 20 for use in viewing portions of the concrete wall 12 that are to be filled with concrete slurry. The stand 10 in the exemplary embodiment shown is thus adjustable in the vertical direction 40 and can pivot about axis 42. In other embodiments the stand 10 can be made to rotate about axis 52 to allow for further versatility in the positioning of hose 16.

Figure 6:
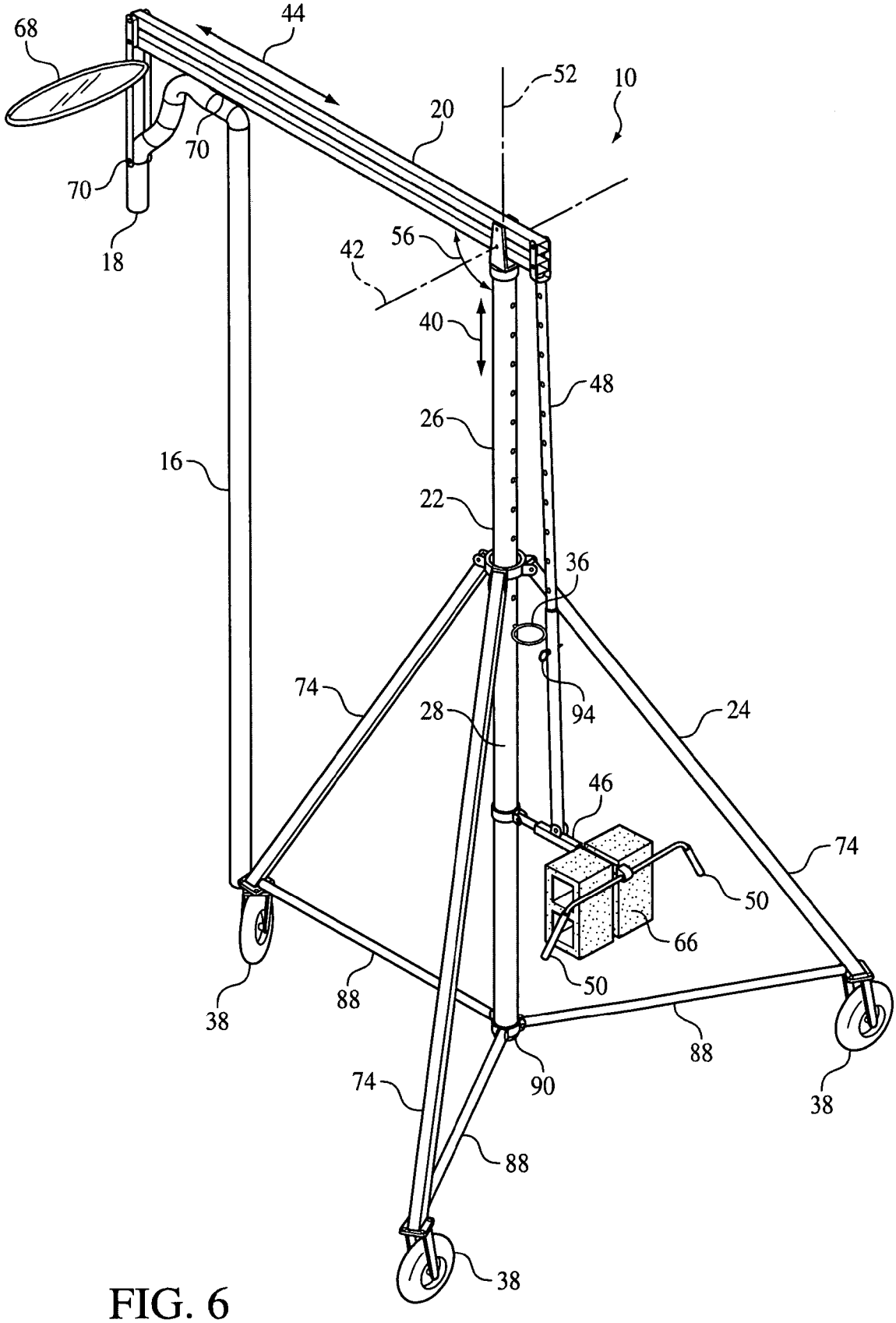
FIG. 6 is a perspective view of a stand for use in pouring concrete in accordance with another exemplary embodiment of the present invention.

Another exemplary embodiment of the stand 10 can be seen in FIG. 6. This exemplary embodiment employs many of the same features previously discussed in relation to the exemplary embodiment of FIG. 5 and need not be repeated. However, the embodiment of FIG. 6 is designed in a manner so that the hose 16 is located on one side of the column 22. This type of arrangement may be necessary at certain job sites where space is an issue. As shown, the hose 16 extends in a vertical direction towards boom 20 and is attached proximate to one end thereof through the use of clamps 70. The hose 16 is thus held at a location near the end of the boom 20. As can be seen, the hose 16 is completely located outside of the footprint established by the base 24. Due to the weight of the concrete slurry flowing through the hose 16 in addition to the location of the hose 16 away from the column 22, a counterweight 66 is provided. The counterweight 66 is attached to the positioning arm 46 and is located within the footprint established by the base 24. The presence of counterweight 66 also allows for the removal of a portion of the boom 20 located on an opposite side of the column 22 from that portion holding the hose 16. As such, the axis 42 about which the boom 20 can pivot is not located at the midpoint of the boom 20.

The stand 10 thus allows the hose 16 to be supported and controlled from the ground. The stand 10 can be rendered movable as discussed and can be manipulated along all three axes of a coordinate system as shown. Alternatively, the stand 10 can be designed so that it is adjustable along only one or two of the axes. The stand 10 may allow for a user to pour concrete slurry to form a concrete wall 12 without having to sit on, stand on, or be supported from the concrete wall 12 or without having to hold the hose 16 which can become tiresome over time.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A stand for use in pouring concrete, comprising:

a vertically-adjustable support column having near and distal ends;

a generally elongated boom for supporting a concrete slurry dispensing hose having a dispensing nozzle, the boom fixedly attached to the distal end of the support column such that the boom is oriented generally perpendicular to the support column, the boom having a dispensing nozzle engaging clamp carried by a first end of the boom, the dispensing nozzle engaging clamp having a first orientation, the boom having a hose supporting clamp carried by a second end of the boom in spaced-apart relationship to the dispensing nozzle engaging clamp, the hose supporting clamp having a second orientation substantially perpendicular to the first orientation of the dispensing nozzle engaging clamp for engaging a central length of the hose;

and a base provided at the near end of said support column and providing stability to said column.

2. The stand as in claim 1, wherein said column has a first portion that is an inner sleeve at least partially disposed within a second portion that is an outer sleeve, and wherein said inner sleeve is movable with respect to said outer sleeve so that the height of said column is adjustable.

3. The stand as in claim 2, further comprising:

a rack carried by said inner sleeve;

a worm in communication with said rack; and a handle in communication with said worm such that movement of said handle causes said worm to rotate to effect movement of said rack so as to cause adjustment of the height of said column.

4. The stand as in claim 2, further comprising a locking member disposed through at least a portion of said inner sleeve and said outer sleeve for preventing relative movement between said inner sleeve and said outer sleeve after said inner sleeve is adjusted to a desired position.

5. The stand as in claim 1, wherein said base has at least three legs that each carries a caster.

6. The stand as in claim 1, wherein said boom is capable of pivoting with respect to said column such that the axis about which said boom pivots is horizontal with respect to the ground.

7. The stand as in claim 1, wherein said boom carries a mirror for use in viewing voids to be filled in a concrete wall.

* * * * *